US005356329A

United States Patent [19]

Thornell

[11] Patent Number: 5,356,329

[45] Date of Patent: Oct. 18, 1994

[54] LIGHT DISPLAY DRIVE FOR A ROCKING TOY

[75] Inventor: Ernest L. Thornell, Gasconade County, Mo.

[73] Assignee: Handi-Pac, Inc., Hermann, Mo.

[21] Appl. No.: 46,302

[22] Filed: Apr. 15, 1993

[51] Int. Cl.[5] ..... A63H 33/00; A63H 13/18; A63H 33/26

[52] U.S. Cl. ..... 446/485; 446/326; 446/396; 446/29; 472/102; 362/802

[58] Field of Search ..... 472/95, 96, 98, 100, 472/101, 102, 114; 446/29, 484, 485, 219, 236, 237, 238, 242, 313, 322, 325, 396, 438, 462; 362/276, 802

[56] References Cited

U.S. PATENT DOCUMENTS

| | | | |
|---|---|---|---|
| 777,369 | 12/1904 | Hayes | 472/101 X |
| 2,611,214 | 9/1952 | Schur | 446/325 |
| 2,836,009 | 5/1958 | Wang | 446/242 |
| 3,580,575 | 5/1971 | Speeth | 362/802 X |
| 4,157,826 | 6/1979 | Sims et al. | 472/98 |
| 4,289,307 | 9/1981 | Marshall, Jr. et al. | 472/98 |
| 4,701,146 | 10/1987 | Swenson | 362/802 X |
| 4,708,689 | 11/1987 | Hou | 446/301 |
| 4,931,029 | 6/1990 | Hwang | 446/175 X |
| 5,030,160 | 7/1991 | Klawitter | 446/484 X |
| 5,217,411 | 6/1993 | Spector et al. | 472/101 X |

FOREIGN PATENT DOCUMENTS

| | | | |
|---|---|---|---|
| 2117258 | 10/1983 | United Kingdom | 446/396 |

*Primary Examiner*—Robert A. Hafer
*Assistant Examiner*—D. Neal Muir
*Attorney, Agent, or Firm*—Polster, Lieder, Woodruff & Lucchesi

[57] ABSTRACT

A ridable toy which is adapted to be rocked by a child has a body on which the child may sit to rock the toy, a translucent portion, and a centrifugally operated light display visible through the translucent portion. The light display is caused to spin and light up by an arcuate rack drive system which is responsive to the rocking motion induced in the toy by the child.

18 Claims, 4 Drawing Sheets

LIGHT DISPLAY DRIVE FOR A ROCKING TOY

BACKGROUND OF THE INVENTION

This invention relates to toys having light displays therein, and, in particular, a drive for a light mechanism in a ridable toy.

One object of this invention is to provide a drive for a light display in a ridable toy.

Another object is to provide such a drive which may be easily operated by small children.

Other objects of this invention will become apparent to those skilled in the art in light of the following description and accompanying drawings.

SUMMARY OF THE INVENTION

In accordance with this invention, generally stated, a toy is provided with a drive mechanism which causes a light display to spin in response to rocking of the toy. The drive mechanism includes a push arm which causes an arcuate rack to pivot. The rack has a toothed edge which meshes with a drive gear. The drive gear, in turn, meshes with a pinion gear fixed to a fly wheel. The light display is mounted on the fly wheel. The light display is preferably mounted at a point spaced from the center of the fly wheel. The light display is rotated by a planetary gear system mounted on the surface of the fly wheel.

The drive also includes a mechanism to allow the fly wheel to free wheel (continue rotating in one direction) when the direction of the rocking motion is changed. This free wheeling is accomplished by urging the drive gear into and out of meshing contact with the fly wheel pinion gear by the motion of the pivoting rack.

DESCRIPTION OF THE PREFERRED EMBODIMENT

Figure 1:
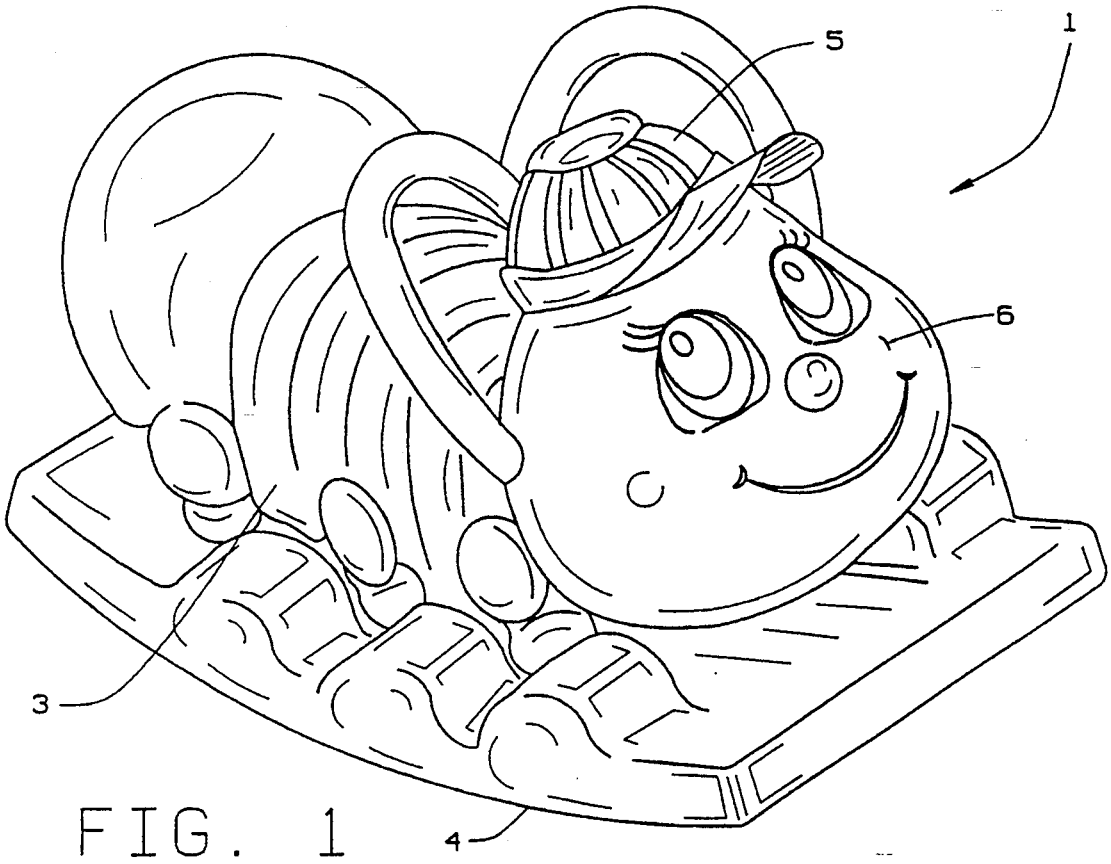
FIG. 1 is a perspective view of a toy having a light show drive mechanism of the present invention.
Figure 3:
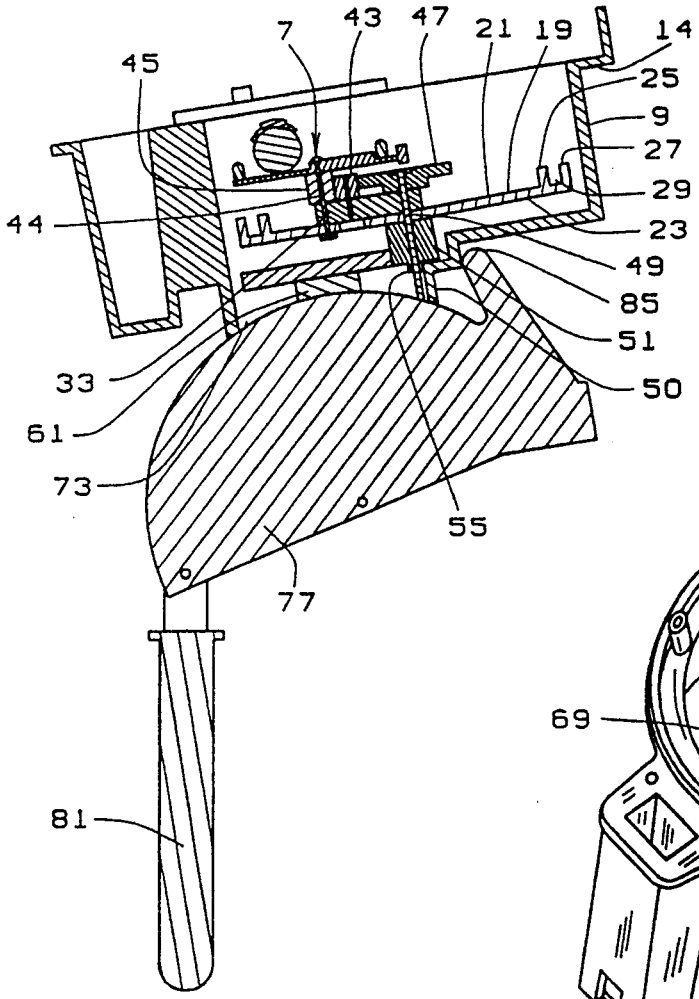
FIG. 3 is a cross-sectional view of the drive mechanism.
Figure 4:
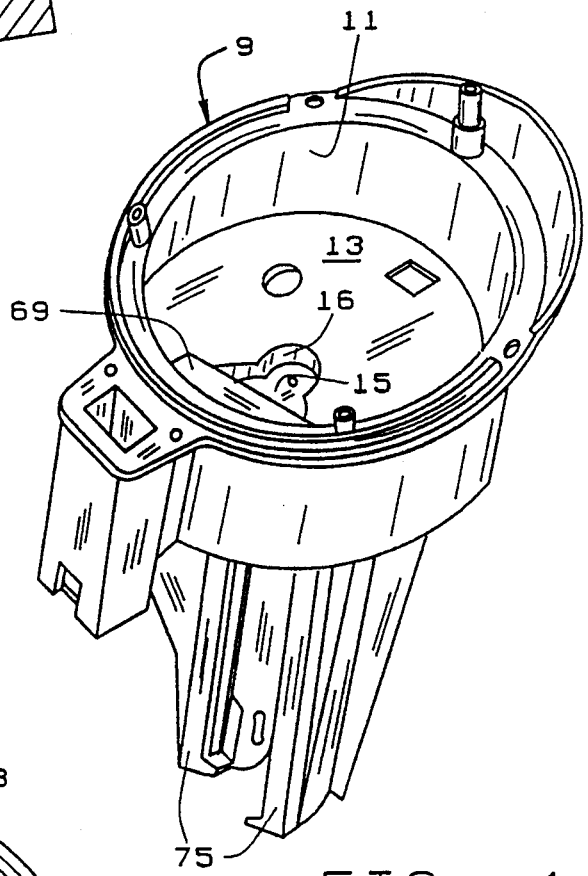
FIG. 4 is a perspective view of a housing for the drive mechanism.
Figure 5:
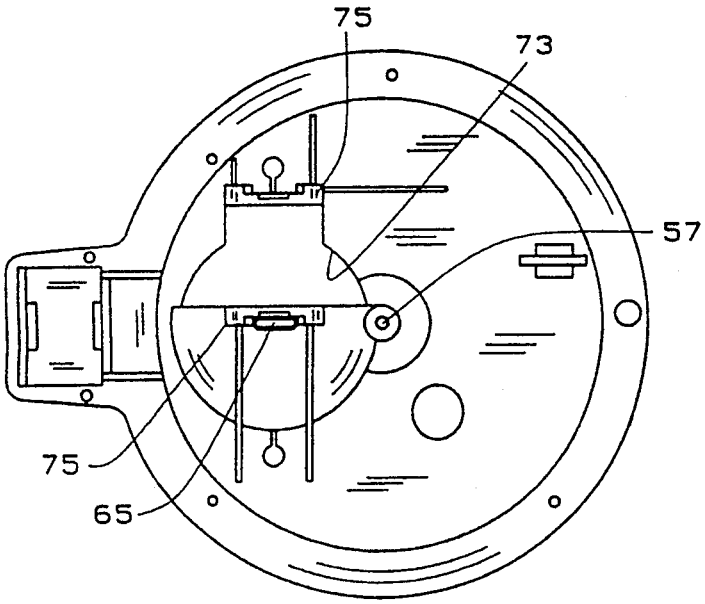
FIG. 5 is a bottom plan view of the housing.
Figure 6:
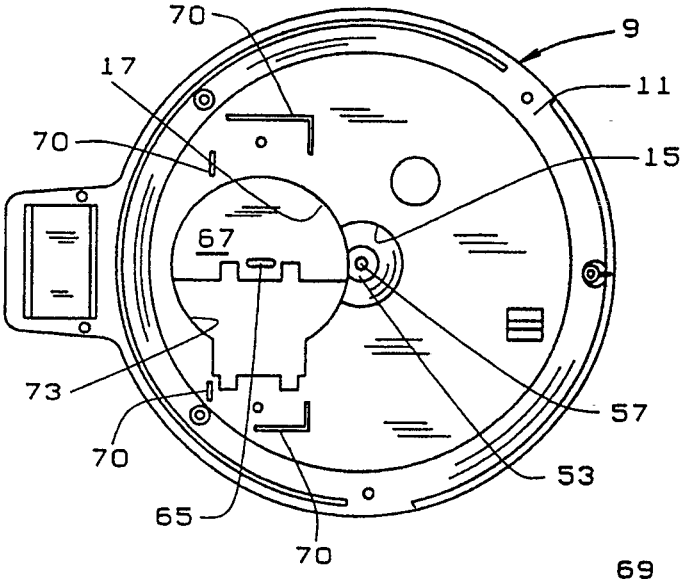
FIG. 6 is a top plan view of the housing.
Figure 7:
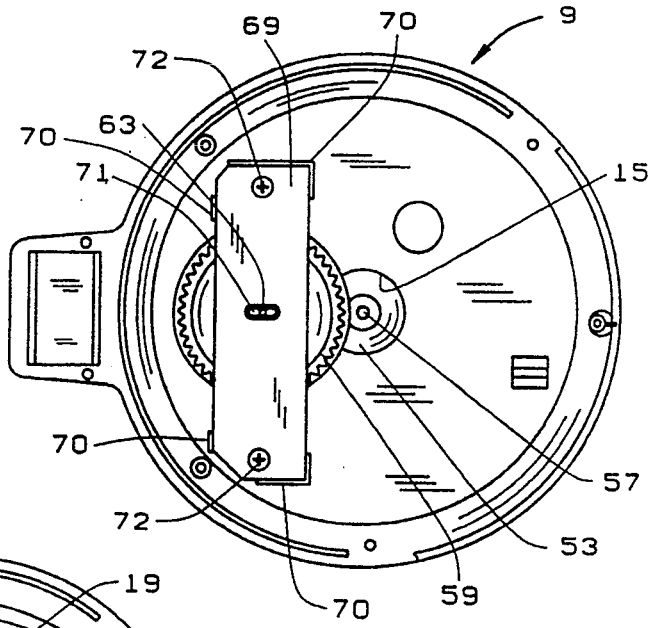
FIG. 7 is a top plan view of the housing with a drive gear and bracket in place.
Figure 8:
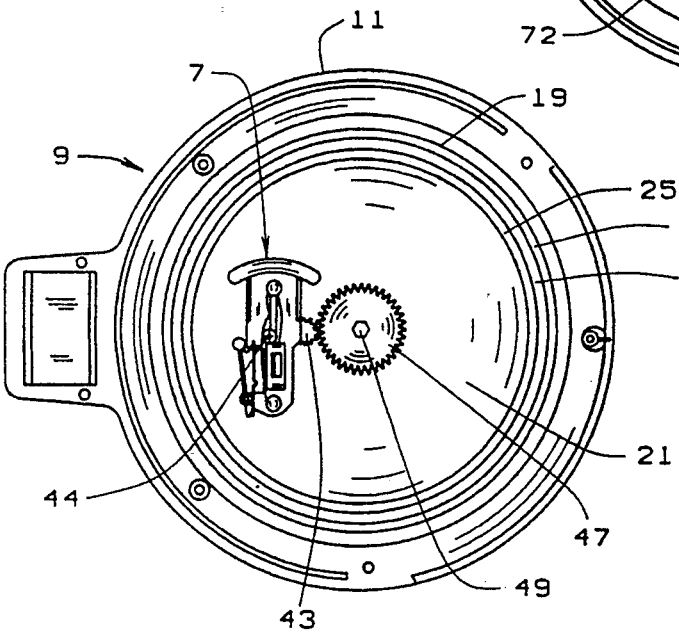
FIG. 8 is a top plan view of the drive.
Figure 9:
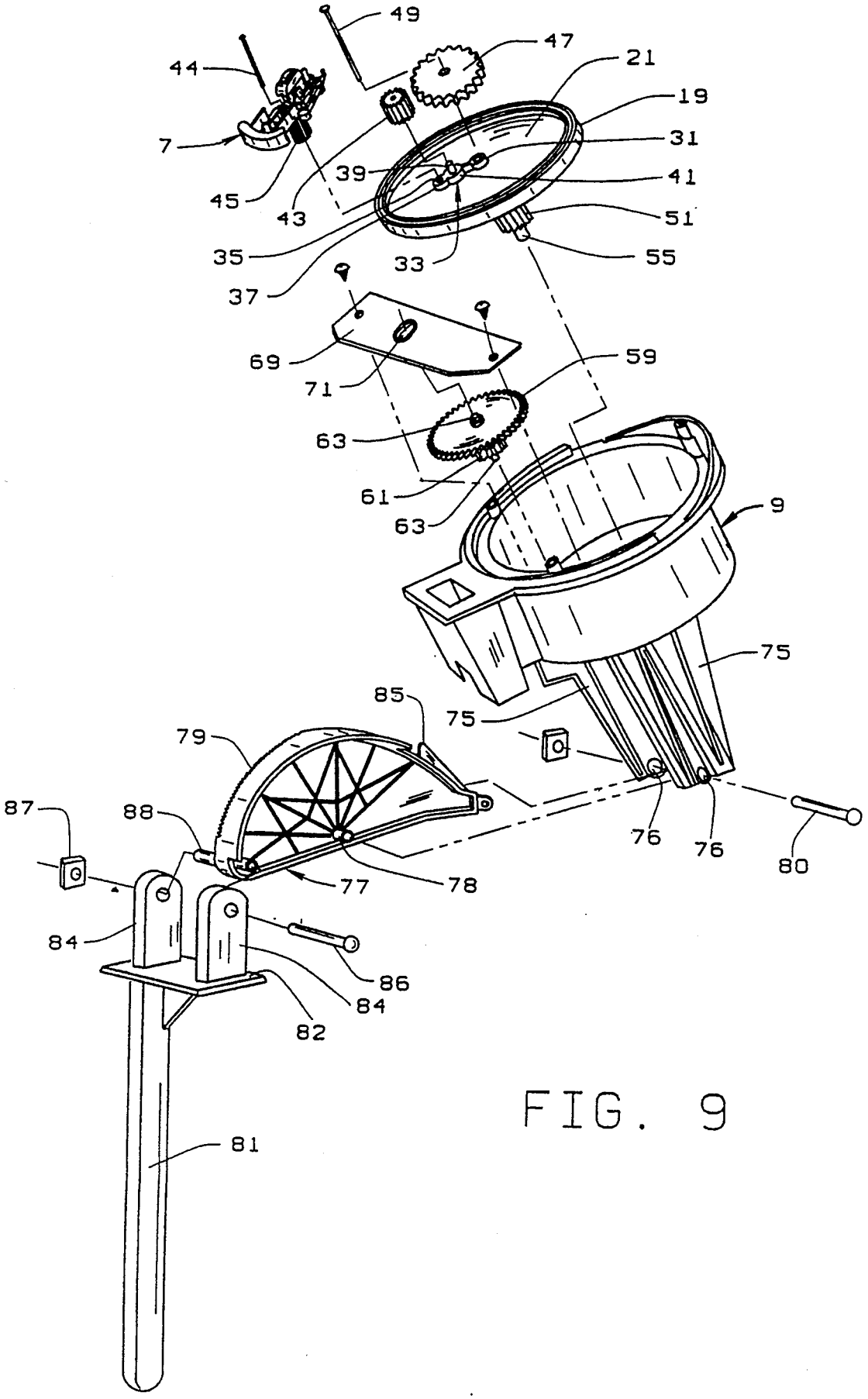
FIG. 9 is an exploded view of the drive.

Referring now to FIG. 1, reference numeral 1 indicates an illustrative embodiment of a rocking toy of the present invention, such as the toy shown in my copending application, Ser. No. 08/003,268, filed Jan. 4, 1993. Toy 1 has a body 3 with a curved bottom surface 4 which permits a child to rock back and forth on the toy and, as will be explained, supplies the energy required to operate the mechanism of this invention. The body 3 has a forward wall portion 6, shown as having a representation of a head with a face on it, crowned with a translucent portion 5, shown as the hat of the head of the toy in the drawing. A light display 7 (FIGS. 3, 8, and 9) is visible through the translucent portion 5. Preferably, the light display is a centrifugally operated display, such as is disclosed in U.S. Pat. No. 5,030,160, which is assigned to the same assignee as the present invention, and which is incorporated herein by reference.

Figure 2:
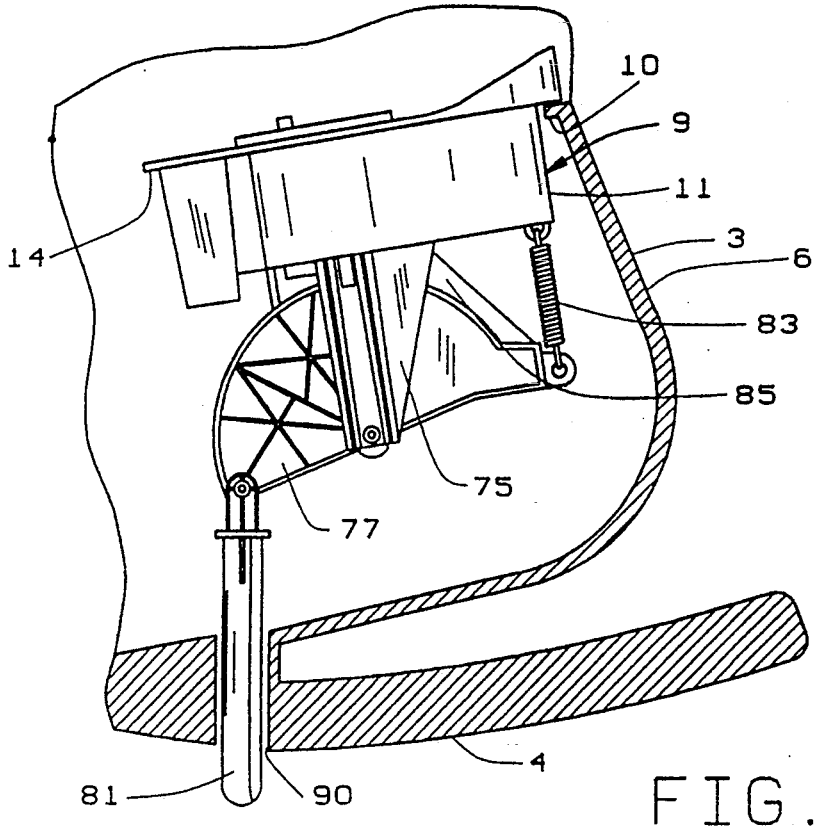
FIG. 2 is a cut-away view of the toy, partly in cross-section, showing the drive mechanism.

Light display 7 is contained in a housing 9 which is mounted in the toy. As shown in FIG. 2, toy body 3 has an inwardly directed lip 10 defining a generally circular ledge corresponding roughly to the perimeter of the housing 9 at the top thereof. Housing 9 is preferably generally cylindrical. It has a side wall 11 and a floor 13. A circumferential flange 14 extends radially outwardly from the top of wall 11. Flange 14 rests on lip 10 of body 3 to support housing 9 in body 3. A plurality of screws or other fasteners which extend through flange 14 and into lip 10 may be used to secure housing 9 in body 3. A circular well 15, with a side wall 16, is formed in the center of floor 13. A second, larger and deeper well 17 is formed in floor 13, offset from the center thereof. Wells 15 and 17 overlap, so that the wall 16 of well 15 is not continuous.

A fly wheel 19 is received in housing 9. Fly wheel 19 has an upper surface 21 and a lower surface 23. A pair of concentric walls 25 and 27 extend up from the periphery of fly wheel 19 and define a channel 29. A journal 31 and a platform 33 extend upwardly from surface 21. Platform 33 is elongate, extending radially from journal 31. Platform 33 has a bore 35 formed in a radially outer part 37 thereof and a stub axle 39 extending upwardly from a radially inner part 41 thereof.

A pinion gear 43 is rotatably received on axle 39. Light display 7 is rotatably secured to fly wheel 19 by an axle 44 which extends through bore 35 and is secured to flywheel 19 such as by a nut or bolt. Light display 7 has a gear 45 which meshes with pinion gear 43.

A stationary gear 47 is fixedly mounted on fly wheel 19 on an axle 49 which extends through journal 31, fly wheel 19, and housing floor 13 into a housing boss 50 in which it is anchored. Gear 47 meshes with pinion gear 43. Gear 47, pinion gear 43 and light display gear 45 thus form a planetary gear system. Gear 47 is stationary and fly wheel 19 rotates about axle 49. Thus, rotation of fly wheel 19 causes pinion gear 43 to revolve around gear 47, thereby causing light display 7 to rotate. The centrifugal action of the light display causes the lights thereon to light up.

A pinion gear 51 is fixed to fly wheel lower surface 23 in the center thereof, beneath journal 31, to rotate with fly wheel 19. Pinion gear 51 is received in the first well 15 of housing floor 13. Well 15 defines a small, concentric depression 53 in the bottom thereof. A small hub 55 is defined on the lower end of pinion gear 51 and is received in depression 53 to center gear 51 in well 15. A bore 57 is formed in the center of well 13. Axle 49 extends through pinion gear 51 into bore 57 to rotatably mount fly wheel 19 and pinion gear 51 in housing 9. Although pinion gear 51 may be separate from fly wheel 19, they are preferably integrally formed.

A drive gear 59 is received in second well 17 to mesh with fly wheel pinion gear 51. A pinion gear 61 is rotationally fixed to the underside of drive gear 59. Pinion gear 61 is preferably integrally formed with drive gear 59. An axle 63 extends from beneath pinion gear 61 and above gear 59. The lower portion of axle 63 is received in an elongated slot 65 defined in floor 67 of well 17. A bracket 69 is secured to housing floor 13 above well 17. Bracket 69 is held in place by retaining walls 70 formed in housing floor 13 and fasteners 72, such as screws. An elongated slot 71, vertically aligned with slot 65, is defined in bracket 69 to receive the upper portion of axle 63. Bracket 69 and floor 67 thus co-act to keep drive gear 59 and pinion gear 61 in place vertically.

Floor 67 does not completely close well 17. Rather, well floor 67 defines an opening 73. Floor 67 is shaped such that the teeth of pinion gear 61 are exposed by opening 73.

A pair of arms 75 extend downwardly from the underside of housing floor 13 on either side of opening 73. Each arm has an opening 76 at the bottom thereof. Openings 76 are axially aligned. A generally semi-circular rack 77 is pivotally mounted between arms 75 at the ends thereof. Rack 77 has a journal 78 sized to fit between arms 75. An axle 80 extends through arm openings 76 and rack journal 78 to pivotally mount the rack. Rack 77 extends partly through opening 73 and includes teeth 79 on one side thereof which mesh with pinion gear 61. Thus, pivoting motion of rack 77 will cause fly wheel 19 to rotate, imparting a spinning motion to light display 7 to operate display 7.

A push arm 81 is pivotally attached to one end of rack 77. Push arm 81 has a platform 82 formed at the top thereof. A pair of ears 84 extend upwardly from platform 82. Ears 84 are spaced apart a distance slightly greater than the width of rack 77 to sandwich the rack. An axle 86 extends through a journal 88 formed in one end of rack 77 to pivotally secure push arm 81 to rack 77. The axle 86 is kept from slipping out by a suitable fastener 87, such as the nut shown in FIG. 9.

Arm 81 extends out of body 3 through an opening 90 in bottom thereof. When toy 1 is rocked by a child, toy 1 will move vertically with respect to push arm 81, bearing down thereon. The downward or forward rocking motion of the toy will cause push arm 81 to pivot rack 77. A spring 83 extends between another end of rack 77 and the underside of housing floor 13. Thus, when toy 1 rocks upwardly or backwardly, spring 83 will pivot rack 77 in an opposite direction. Rack 77 includes a stop 85 formed on an end opposite of journal 88 to prevent rack 77 from pivoting in a backward direction beyond a desired point. As seen in FIG. 2, stop 85 interacts with the wall 16 of well 15.

In the embodiment shown and described above, the drive, made up of the push arm 81, rack 77, and gears 61, 59, 51,45, 43, and the planetary gear system mounted on the top fly wheel 19 does not prevent the fly wheel from spinning when the toy changes its rocking direction, i.e., fly wheel 19 is allowed to free wheel. The free wheeling characteristic of fly wheel 19 is provided by the mounting arrangement of drive gear 59 and its pinion gear. The openings 65 and 71 in well floor 67 and bracket 69, respectively, are elongate. This allows the gear 59 to be moved into and out of engagement with fly wheel pinion gear 51. When the toy is rocked forward, the forward component of the force produced by the rack 77 rotates the drive gear 59 in a forward direction and pushes it into contact with fly wheel pinion 51. When the toy is rocked backward, the rack pivots back. The backward motion of the rack is supplied by the spring 83 and pulls the drive gear 59 out of meshing contact with fly wheel pinion 51 as the drive gear is driven in its opposite direction. This way, the fly wheel will rotate in one direction. It will be understood that the rack 77 and drive/drive pinion gear could mesh to drive the fly wheel in a counter-clockwise, rather than a clockwise, direction.

The foregoing description has been set forth for illustrative purposes only. Numerous variations, within the scope of the appended claims, will be apparent to those skilled in the art. For example, fixed gear 47 could be integral with fly wheel 19, rather than a separate gear. Other means for releasing the pinion gear from the drive gear can be provided. The drive gear can be spring biased in a direction out of engagement with fly wheel pinion gear 51 to facilitate their disengagement. The preferred embodiment works and has the advantage of simplicity. These examples are merely illustrative.

Having thus described the invention, what is claimed and desired to be secured by Letters Patent is:

1. A ridable toy adapted to be rocked by a child, the toy having a body on which the child may sit to rock the toy, a translucent portion, a centrifugally operated light display visible through said translucent portion, and a drive for operating said light display in response to the rocking of said toy, said drive including free wheeling means for continuously rotating said light display in a single direction while said toy is rocked;

said drive including a drive gear and a fly wheel operatively connected to said drive gear to be rotated thereby, said light display being mounted on said fly wheel, said fly wheel and light display including intermeshing gears which cause said light display to rotate when said fly wheel is rotated; said free wheeling means including meshing means for engaging and disengaging said drive gear from said fly wheel in response to the rocking of said toy.

2. The toy of claim 1 wherein said drive includes a push arm operatively connected to said light display, said push arm bing slidably mounted in said body and extending out of said body to be in contact with a floor, wherein when said body rocks, said body moves with respect to said push arm.

3. The toy of claim 2 further including a housing mounted in said toy.

4. The toy of claim 3 wherein said housing has a floor; a well defined in said floor, the well having a bottom defining an opening; and arms extending downwardly from a bottom side of said housing floor.

5. The toy of claim 1 wherein said drive gear includes an axle and is rotatably mounted in a bracket, said bracket including elongate openings which receive said drive gear axle, said meshing means transversely moving said drive gear in said bracket to engage with, and disengage from, said drive gear from said fly wheel.

6. The toy of claim 5 wherein said meshing means includes a rack pivotally mounted in said toy body and a push arm connected to said rack and extending through said toy body to engage a floor such that when said toy is rocked forwardly the rack pivots in one direction, and when the toy is rocked rearwardly, the rack is pivoted in a second, opposite, direction; said rack having a toothed edge operatively connected to said drive gear to drive said drive gear such that when said rack is pivoted in one of said first or second directions, said drive gear is moved into engagement with said fly wheel to positively drive said fly wheel and when said rack is pivoted in the other of said first and second directions, said drive gear is disengaged from said fly wheel and said fly wheel free wheels in said toy.

7. A ridable toy adapted to be rocked by a child, the toy having a body on which the child may sit to rock the toy;

a translucent portion mounted upon said body;

a centrifugally operated light display visible through said translucent portion;

a drive for operating said light display in response to the rocking of said toy, said drive including a push arm operatively connected to said light display, said push arm being slidably mounted in said body and extending out of said body to be in contact with a floor, wherein when said body rocks, Said body moves with respect to said push arm;

a housing mounted in said toy, said housing having a floor; a well defined in said floor, the well having a bottom defining an opening; and arms extending downwardly from a bottom side of housing floor; and a rack pivotally secured to said housing arms; said push arm being pivotally secured to said rack.

8. The toy of claim 7 wherein said rack has an arcuate surface having teeth in an edge thereof, said arcuate section extending into said well through said opening; said drive mechanism including a driven gear rotatably mounted in said well to be in meshing contact with said rack teeth; said driven gear being operated by said rack when said rack is pivoted by said push arm.

9. The toy of claim 8, said drive further including a fly wheel mounted in said housing, said fly wheel being driven by said driven gear; said centrifugal light display being rotatably mounted to said fly wheel to be rotated as said fly wheel is rotated.

10. The toy of claim 9 wherein said drive includes means for allowing said fly wheel to disengage from said driven gear to spin freely.

11. The toy of claim 10 wherein said disengaging means includes means for allowing said driven gear to move transversely, said driven gear being moved into meshing contact with a fly wheel gear when said push arm is pushed upwardly with respect to said body and is moved out of meshing contact with said fly wheel gear when said push arm is pushed downwardly with respect to said body.

12. The toy of claim 10 wherein said said driven gear includes an axle, one end of said axle being journaled in said bottom of said well and another end of said axle being journaled in a bracket mounted to said housing floor above said well; said transverse moving means including said well floor and said bracket, said well floor and said bracket including an elongate slot, said driven gear axle being journaled in said elongate slots for transverse movement.

13. A drive mechanism for rotating a light display in a rockable toy, said drive mechanism being operatively connected to said light display to rotate said light display in response to rocking motion of said toy;

said toy including a drive a housing mounted therein, said housing having a floor; a well defined in said floor, the well having a bottom defining an opening; and arms extending downwardly from a bottom side of said housing floor;

said drive including a push arm operatively connected to said light display, said push arm being slidably mounted in said toy and extending out of said toy to be in contact with a floor, whereby when said top rocks, said toy moves with respect to said push arm; and an arcuate rack pivotally secured to said housing arms; said push arm being pivotally secured to said rack.

14. The drive mechanism of claim 13 wherein said rack has an arcuate surface having teeth in an edge thereof, said arcuate section extending into said well through said opening; said drive mechanism including a driven gear rotatably mounted in said well to be in meshing contact with said rack teeth; said driven gear being operated by said rack when said rack is pivoted by said push arm.

15. The drive mechanism of claim 14, said drive further including a fly wheel mounted in said housing which is driven by said driven gear; said light mechanism being rotatably mounted to said fly wheel to be rotated as said fly wheel is rotated.

16. The drive mechanism of claim 15 wherein said drive includes means for allowing said fly wheel to disengage from said driven gear to spin freely.

17. The drive mechanism of claim 16 wherein said disengaging means includes means for allowing said driven gear to move transversely, said driven gear being moved into meshing contact with said fly wheel when said push arm is pushed upwardly with respect to said body and is moved out of meshing contact with said with said fly wheel when said push arm is pushed downwardly with respect to said body.

18. The drive mechanism of claim 17 wherein said said driven gear includes an axle, one end of said axle being journaled in said bottom of said well and another end of said axle being journaled in a bracket mounted to said housing floor above said well; said transverse moving means including said well floor and said bracket, said well floor and said bracket including an elongate slot, said driven gear axle being journaled in said elongate slots for transverse movement.

* * * * *

UNITED STATES PATENT AND TRADEMARK OFFICE

CERTIFICATE OF CORRECTION

PATENT NO. : 5,356,329

DATED : October 18, 1994

INVENTOR(S) : Ernest L. Thornell

It is certified that error appears in the above-identified patent and that said Letters Patent is hereby corrected as shown below:

Column 1, Line 56, delete "Ser.No. 08/003,268" and insert -- Ser.No. 29/003,268

Column 5, Line 6, delete "Said" and insert -- said --

Column 5, Line 11, after "side of" insert -- said --

Signed and Sealed this

Twenty-seventh Day of December, 1994

*Attest:*

Bruce Lehman

BRUCE LEHMAN

*Attesting Officer*

*Commissioner of Patents and Trademarks*